US005191846A

United States Patent [19]

Clay

[11] Patent Number: 5,191,846

[45] Date of Patent: Mar. 9, 1993

[54] SELF-CONTAINED HOUSEHOLD GARBAGE INCINERATOR

[76] Inventor: Haile S. Clay, P.O. Box 326, La Honda, Calif. 94020

[21] Appl. No.: 829,421

[22] Filed: Feb. 3, 1992

[51] Int. Cl.[5] ..... F23G 5/00

[52] U.S. Cl. ..... 110/346; 110/186; 110/193; 110/235; 110/242; 126/224

[58] Field of Search ..... 110/346, 242, 250, 237, 110/193, 235, 253, 186; 126/224; 431/326, 328

[56] References Cited

U.S. PATENT DOCUMENTS

| | | | |
|---|---|---|---|
| 3,076,605 | 2/1963 | Holden | 431/328 X |
| 3,882,797 | 5/1975 | Eff | 110/250 X |
| 4,934,283 | 6/1990 | Kydd | 110/237 X |
| 5,062,372 | 11/1991 | Ritter | 110/242 |

FOREIGN PATENT DOCUMENTS

| | | | |
|---|---|---|---|
| 876340 | 7/1971 | Canada | 110/250 |

*Primary Examiner*—Edward G. Favors
*Attorney, Agent, or Firm*—Ware & Freidenrich

[57] ABSTRACT

The present invention includes a chamber for containing refuse, a porous membrane at least partially enclosing the chamber, and a housing enclosing the porous membrane and the chamber. Combustion fuel is supplied to the porous membrane so that surface combustion taken place at the surface of the porous membrane facing the chamber for burning the refuse contained in the chamber. Electrical means may also be employed to provide combustion of the refuse. Safety features include pressure feed-back means for monitoring and regulating the pressure within the apparatus and temperature feed-back means for monitoring and regulating the temperature within the apparatus. A particle bin is positioned below the chamber for receiving burned particles from the chamber.

13 Claims, 2 Drawing Sheets

SELF-CONTAINED HOUSEHOLD GARBAGE INCINERATOR

FIELD OF THE INVENTION

The present invention relates to an incinerator apparatus. More specifically, it relates to a self-contained incinerator and method for burning refuse in a non-industrial environment.

BACKGROUND OF THE INVENTION

For many years residents burned their own refuse in outdoor residential incinerators which did not have air pollution reducing devices incorporated therein. Most local and state governments have outlawed residential burning activities due to the air pollution problems created by the burning. Instead of burning, residents now send their waste to landfills. However, currently, landfills are being filled to capacity and new landfill sites are becoming less available.

In an effort to solve the landfill problems, communities are turning to recycling and municipal incineration to dispose of refuse. However, these solutions are still in the formative stages and therefore do not provide immediate relief from the ongoing problems of waste management.

Until the methods of recycling and municipal incineration are viable solutions for waste management, other methods are needed to relieve the landfill problems. Accordingly, there is a need for a new type of residential incinerator which does not add to air pollution as did the residential incinerators of the past. Furthermore, there is a need for a residential incinerator which operates in a convenient manner, is compact and is safe for residential use.

OBJECTS AND SUMMARY OF THE INVENTION

It is therefore a general object of the present invention to provide an improved residential incinerator apparatus.

It is another object of the present invention to provide a refuse burning apparatus and method which burns refuse without releasing air polluting contaminants into the ambient environment.

It is a further object to provide an incineration apparatus safe for indoor residential use.

It is a still another object to provide an incinerator with a short, closed cycle process.

It is a yet a further object of the present invention to provide an incinerator which is self cleaning.

It is yet another object to provide an incinerator which is compact, portable and has no emission stack.

In accordance with these and other objects, the present invention includes a chamber for containing refuse, a porous membrane at least partially enclosing the chamber, and a housing enclosing the porous membrane and the chamber. Combustion fuel is supplied to the porous membrane so that surface combustion takes place at the surface of the porous membrane facing the chamber for burning the refuse contained in the chamber. Safety features include pressure feed-back means for monitoring and regulating the pressure within the apparatus and temperature feed-back means for monitoring and regulating the temperature within the apparatus. A particle bin is positioned below the chamber for receiving burned particles from the chamber.

BRIEF DESCRIPTION OF THE DRAWINGS

Other objects, and many of the intended advantages of the present invention, will be readily appreciated as the same becomes better understood by reference to the following detailed description when considered in connection with the accompanying drawings wherein.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the claims.

Figure 1:
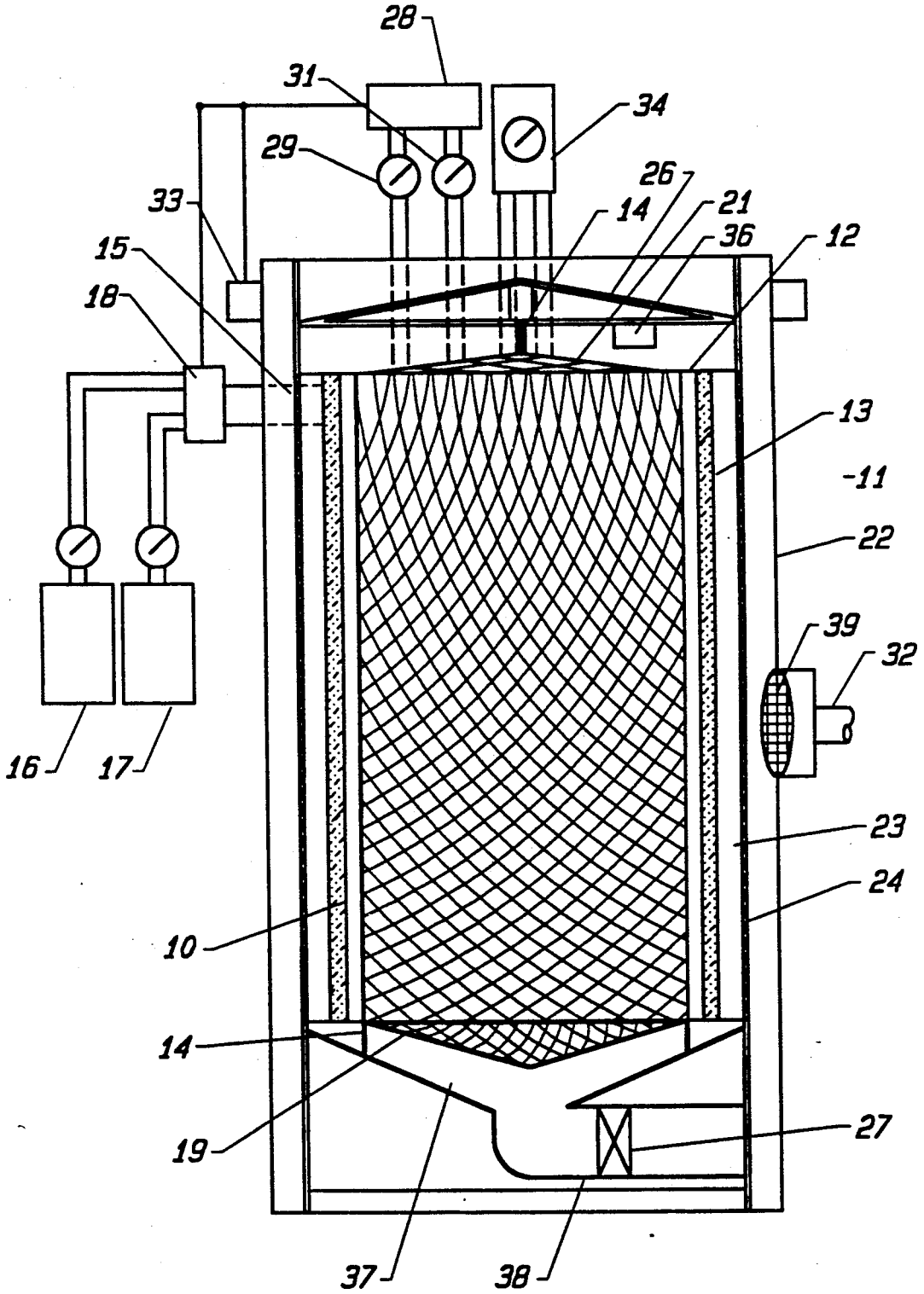
FIG. 1 is a cross-sectional side view of the present invention.
Figure 2:
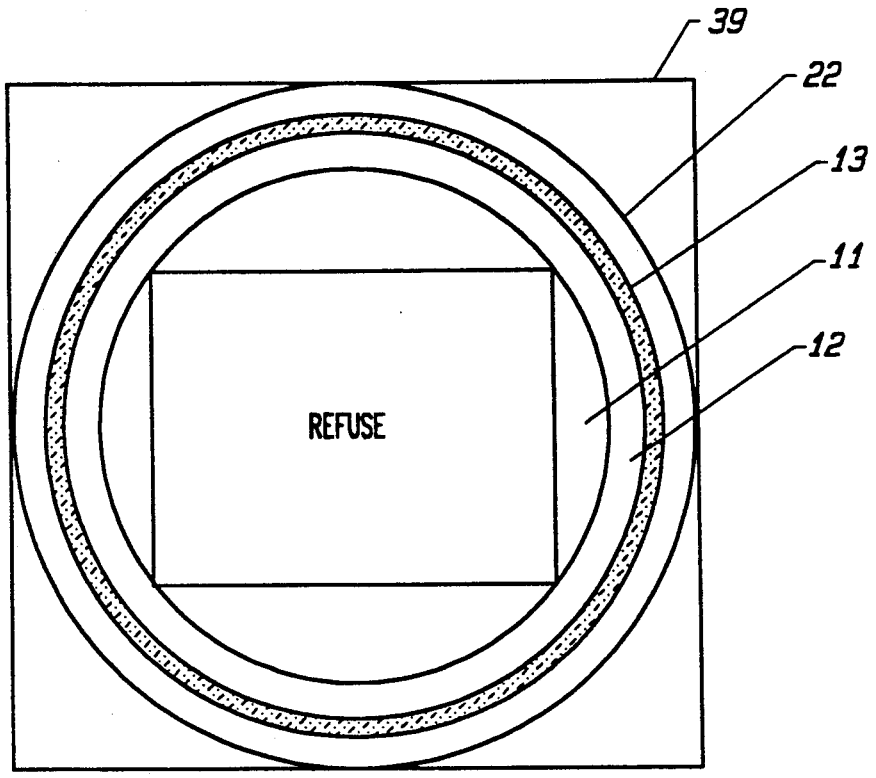
FIG. 2 is a cross-sectional top view of the present invention.

Attention is drawn to FIGS. 1 and 2 which show cross-sectional views of the present invention which operates utilizing the process known as surface combustion. Incineration of refuse contained within the apparatus is effected by the configuration of the elements of the present invention, namely, the chamber 11 for holding refuse and a porous membrane 13 which is separated by a coaxial air space 12 from the chamber 11. The chamber is supported by supports 14 so that around the chamber 11, a uniform coaxial air space 12 is maintained. The porous membrane 13 acts as a combustion wall and a radiating surface facing inwardly to the chamber 11. The membrane is constructed from porous refractory material such as graphite, which is also a neutral refractory material. The porous membrane discharges the fuel supplied from the fuel supply 15.

This invention, in the first embodiment, uses combustion gases to produce a radiant heat source. If, however, the radiant heat source was produced by electrical means, such alteration would fall within the scope of the present invention. Electrical means may be provided by replacing membrane 13 with glowing tubes or a hot-plate-type heat source, or other electrical configuration.

Fuel supply 15 is a mixture of industrial oxygen air 16 and methane 17, which is combined at mixing valve 18. Such fuels are obtainable in small pressurized containers for easy installation on the apparatus of the present invention. Other equally combustible combinations of fuel, such as, propane, acetylene, butane or hydrogen, can combined to effect the surface combustion at the porous membrane described herein.

Surface combustion is an explosive mixture of gas and air in the proper proportions for complete combustion and which is caused to burn without flame in contact with a granular incandescent surface, in this case, porous membrane 13. A large portion of the potential energy of the fuel is immediately converted into radiant form so that accelerated combustion is concentrated at chamber 12. As the surface combustion becomes incandescent, it will produce intense radiation heat that will cause the refuse which is in close proximity to spontaneously combust. Moreover, a reflecting surface maybe included on the surface 10 of the porous membrane 13 facing chamber 11.

Surface combustion provides the attainment of very high temperatures and rapid heating. The proportions of methane and oxygen (purified air which is approximately 99% oxygen) as the fuel used to effect surface combustion per one hundred pounds of compacted refuse are oxygen by volume 67% and methane by volume 33%, a ratio of approximately 2 to 1. Were non-purified air to be used in place of purified air, the ratio of air to burn gas would be approximately 10 to 1. The effective temperature of the refuse is maintained between 1400 to 1700° Fahrenheit.

The surface combustion is supported by the oxygen admitted with the burn gases of fuel supply 15 and is not influenced by the oxygen and other gases that surround the refuse. Because the refuse is burned primarily from radiation heat generated at the porous membrane 13, no combustion air is required to sustain the burning of the refuse. Accordingly, there is no need to supply additional oxygen in the form of air received from the ambient environment to fuel the combustion. The fuel supplied to the porous membrane 13 by fuel supply 15 is sufficient to effect the desired surface combustion. An electronic ignition source or laser may be used to start the combustion.

Chamber 11 houses refuse which is slated for incineration. As the surface combustion generates radiant heat that is transferred from the porous membrane 13 across space 12, intense heat is concentrated at the chamber 11. Since the surface combustion becomes incandescent instantaneously, the complete burn cycle of the incinerator is finished within a short time. The incineration of all of the refuse within the chamber 12 is fast and complete. Due to the intense heat and speed of the incineration, gases produced from the refuse during the incineration process are completely burned, therefore, there are no air contaminants left in the system to release to the ambient environment, thus providing a pollution free incineration apparatus. Accordingly, there is no requirement for a flue or emission stack to exhaust unburned nitrogen and related flue type discharges.

Chamber 11 consists of a wire cylinder, rectangle or other suitable configuration which is enclosed at the bottom 19 and at hinged top lid 21. The wire is preferably of the type which has a minimum chemical interaction with refuse and the burn gases. Furthermore, the wire must be strong enough to sustain impacts from exploding items of the refuse such as used spray cans. A suitable type of wire is, for example, titanium, or stainless steel.

The chamber 11 surrounded by porous membrane 12 is positioned within an air-tight housing 22 which is sealed during the combustion and cool down periods to prevent any escape of gasses and burning particulates. A strong material which is able to withstand the temperatures and pressures generated from within the apparatus and which is inert to the refuse and gases produced from the incineration is preferable. Housing 22 is therefore preferably constructed from, for example, stainless steel. The housing 22 is also insulated by insulation 24 to prevent heat from escaping into the ambient environment.

The housing 22 surrounds a back-pressure chamber 23 which forces the mixture of fuels through the porous membrane 13 to sustain the surface combustion. Back-pressure chamber 23 is coaxial to porous membrane 13 to achieve uniformity of the surface combustion. Upon closure of lid 26 and clean out plug 27, the housing 22 becomes a pressure tank and therefore lid 26 and clean out plug 27 are also constructed to adequately endure the temperatures and pressures from within the apparatus.

Feed-back systems monitor and regulate the operating parameters of the apparatus. Pressure feed-back means and temperature feed-back means are provided by feed-back system 28. The pressure feed-back system monitors the pressure through pressure monitor 29 and the temperature feed-back system monitors the temperature through temperature monitor 31. The pressure is controlled by varying temperature and by releasing pressure through pressure release valve 32 Accordingly, the internal pressure of the apparatus maybe maintained at 100 psi. Release valve 32 is shielded by a filter that removes contaminants from the passing gas. Charcoal would be a typical filtering material for this purpose.

The temperature is controlled by adjusting the fuel supply. The feed-back system 28 is equipped with an automatic shut-down mechanism in the event that the pressure or temperature exceed safety limitation threshold values. Furthermore, the feed-back system also monitors the seal of the lid 27 at hinge 33 and at the plug 27.

The refuse which is placed in chamber 11 is preferably compacted by a trash compactor. The chamber 11 may hold up to 100 pounds of refuse and therefore four times the volume of the average household trash compactor. Preferably, the refuse is introduced into the chamber 11 in a bag so that debris is not forced through the wire mesh prior to combustion. The apparatus of the present invention as shown is compact, having dimensions nearly equivalent to those of a household trash compactor. Since refuse varies in composition, a humidity monitor and regulator 34 is also provided to sustain a humidity level of between 0–1% in the radiant heat transfer zone to assure a complete burn of the enclosed refuse.

Figure 3:
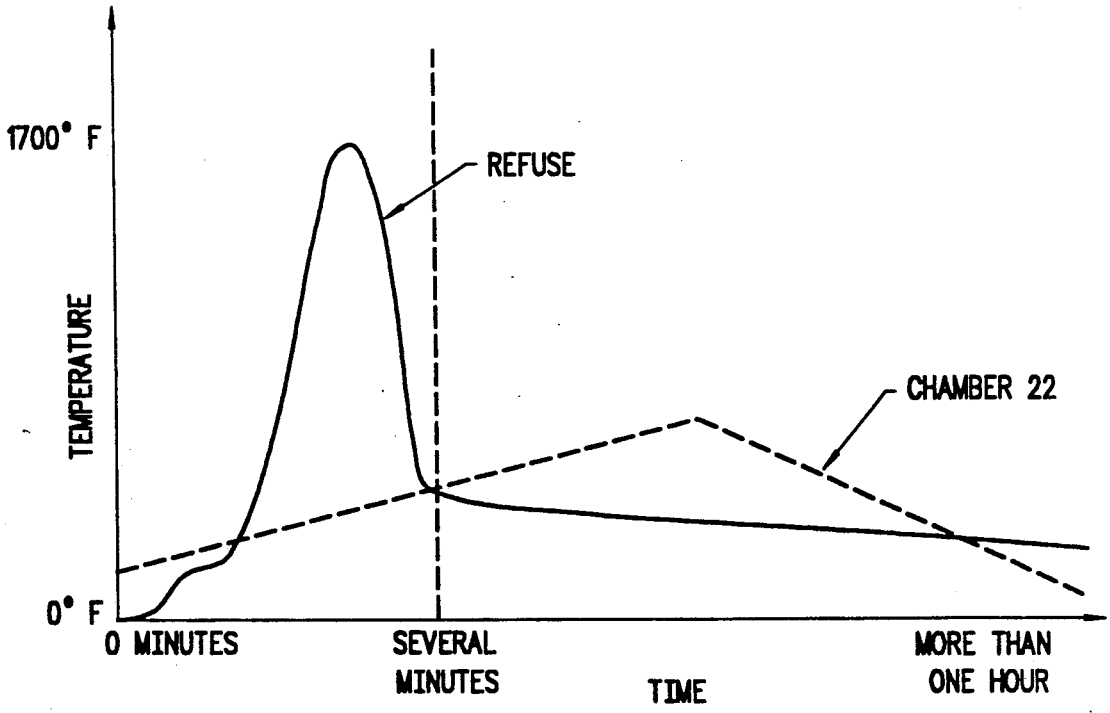
FIG. 3 is a graph of the temperature verse time showing the burn cycle of the refuse and the temperature cycle of the chamber.

FIG. 3 depicts expected temperature verse time curves of the refuse (indicated by the solid line) and the chamber 22 (indicated by the dotted line). The burn cycle of the present invention is summarized as follows. The combustion surface is ignited so that the radiant heat is instantaneously transferred to the refuse. In the first moments of the refuse being subjected to the intense radiant heat emanating from the porous membrane, the moisture embodied in the refuse is driven off as steam. The steam rises to the top of the interior of the apparatus where it is condensed and channeled to the bottom of the incinerator (not shown). The dried refuse is burned to ashes as a consequence of the intense heat radiating from the porous membrane 13. As shown in FIG. 3, the burn cycle is completed within minutes.

As further shown in FIG. 3, the ambient temperature within housing 22 is considerably below the refuse burn temperature due to the directness of radiant heat, the condensing steam and water collected in the base of the unit. The cool down period may take more than an hour to return the system back to room temperature.

The near spontaneous combustion of the refuse in chamber 11 eliminates the need to stir or agitate the refuse to sustain its burning. As the garbage is burned, its ashes fall by the force of gravity to the incinerator floor. Also, means for providing sonic vibrations, such as vibrator 36, is provided to force ashes off the core of unburned refuse to expose it directly to the surface combustion at the porous membrane's 13 interior surface. Therefore, the core of the refuse is continually exposed to the radiant heat at the surface of the porous membrane 13, thereby accelerating the complete burning of the column of refuse.

The bottom 19 of the chamber 11 is replaceable in the event that it becomes clogged by molten glass, plastics and metals which resolidify during the cool-down phase. The matter which does pass through bottom 19 of chamber 11 travels through the ash space 37 which is a particle bin and ultimately exits the apparatus through clean-out duct 38.

A decorative and dimensionally appropriate exterior 39 may be provided enclosing housing 22 so that the apparatus of the present invention easily fits into a kitchen or service porch along side other household appliances. While the disclosure herein has been directed toward describing an incinerating apparatus for use in a residential environment, the present invention is equally applicable to industrial environments. The dimensions of the apparatus for use in an industrial environment may be enlarged, however, the same principles as described herein are applicable to commercial incinerators as well.

Clearly, the general object of the present invention to provide an improved residential incinerator apparatus has been met. Also, the object of the present invention to provide refuse burning apparatus and method for burning which burns refuse without releasing air polluting contaminants into the ambient environment has been met. Moreover, the object to provide an incineration apparatus safe for indoor residential use has been met as has the object to provide an incinerator with a short, closed cycle process. Furthermore, the object of the present invention to an incinerator which is self cleaning has also been met. Finally, the object to provide an incinerator which is compact, portable and has no emission stack has also been met.

While the present invention has been shown and described in what is presently conceived to be the most practical and preferred embodiment of the invention, it will become apparent to those of ordinary skill in the art that many modifications thereof may be made within the scope of the invention, which scope is to be accorded the broadest interpretation of the claims so as to encompass all equivalent structures.

I claim:

1. A self-contained incinerator apparatus for burning refuse, comprising:

a chamber for containing refuse;

a porous membrane at least partially enclosing said chamber;

an air-tight housing enclosing said porous membrane and said chamber;

fuel means for supplying fuel to said porous membrane; and surface combustion means at the surface of said porous membrane facing said chamber for burning refuse contained in said chamber by surface combustion.

2. An apparatus as recited in claim 1 wherein said fuel comprises a mixture of methane and enriched industrial oxygen air.

3. An apparatus as recited in claim 1 wherein said chamber, said porous membrane and said air-tight housing are coaxial to one another.

4. An apparatus as recited in claim 1 further comprising:

pressure feed-back means for monitoring and regulating the pressure within said apparatus; and pressure shut-off means for discontinuing the supply of fuel to said apparatus according to said pressure feedback means.

5. An apparatus as recited in claim 1 further comprising:

temperature feed-back means for monitoring and regulating the temperature within said apparatus;

temperature shut-off means for discontinuing the supply of fuel to said apparatus according to said temperature feed-back means.

6. An apparatus as recited in claim 1 wherein said surface combustion provides temperatures between 1400 and 1700° Fahrenheit.

7. An apparatus as recited in claim 1 wherein the internal pressure of said apparatus is approximately 100 psi.

8. An apparatus as recited in claim 1 further comprising means for driving the moisture content of the refuse to between 0% and 1%.

9. An apparatus as recited in claim 1 further comprising a particle bin positioned below said chamber for receiving burned particles from said chamber.

10. An apparatus as recited in claim 1 further comprising a reflecting surface on the surface of said porous membrane facing said chamber.

11. A method for incinerating refuse in a non-industrial environment, comprising the steps of:

providing a chamber for containing refuse;

providing a porous membrane at least partially enclosing said chamber;

providing an air-tight housing enclosing said porous membrane and said chamber;

supplying fuel to said porous membrane; and burning said refuse by surface combustion at the surface of said porous membrane facing said chamber.

12. A method as recited in claim 11, further comprising the steps of:

assigning a danger threshold internal pressure value of said apparatus;

monitoring the pressure within said apparatus;

regulating the pressure within said apparatus;

discontinuing the supply of fuel to said apparatus when the pressure of said apparatus exceeds the threshold internal pressure value.

13. A method as recited in claim 11 further comprising:

assigning a danger threshold internal temperature value of said apparatus;

monitoring the pressure within said apparatus;

regulating the pressure within said apparatus;

discontinuing the supply of fuel to said apparatus when the temperature of said apparatus exceeds the threshold internal temperature value.

* * * * *